US008172429B2

(12) United States Patent
Ko

(10) Patent No.: US 8,172,429 B2
(45) Date of Patent: May 8, 2012

(54) TABLE LAMP WITH ROTATABLE LAMP CASING

(76) Inventor: Hun-Yuan Ko, Taipei County (TW)

( * ) Notice: Subject to any disclaimer, the term of this patent is extended or adjusted under 35 U.S.C. 154(b) by 382 days.

(21) Appl. No.: 12/533,013

(22) Filed: Jul. 31, 2009

(65) Prior Publication Data

US 2011/0026260 A1 Feb. 3, 2011

(51) Int. Cl.
*F21V 19/02* (2006.01)

(52) U.S. Cl. ..... 362/285; 362/217.02; 362/249.02; 362/268; 362/269

(58) Field of Classification Search ..... 362/551, 362/558, 559, 577, 581, 582, 102, 222, 223, 362/224, 217.02, 240, 249.01–249.11, 268, 362/269

See application file for complete search history.

(56) References Cited

U.S. PATENT DOCUMENTS

| | | | | |
|---|---|---|---|---|
| 2,090,439 | A * | 8/1937 | Carwardine | 248/160 |
| 3,341,702 | A * | 9/1967 | Neumann | 362/269 |
| 3,742,206 | A * | 6/1973 | Summa | 40/441 |
| 3,781,538 | A * | 12/1973 | Brudy et al. | 362/542 |
| 6,520,655 | B2 * | 2/2003 | Ohuchi | 362/612 |
| 6,853,151 | B2 * | 2/2005 | Leong et al. | 315/185 R |
| 6,860,619 | B2 * | 3/2005 | Swanson | 362/249.11 |
| 7,186,007 | B1 * | 3/2007 | Rotwitt | 362/287 |
| 7,441,930 | B2 * | 10/2008 | Lin | 362/410 |

* cited by examiner

*Primary Examiner* — Anabel Ton
*Assistant Examiner* — Danielle Allen

(57) ABSTRACT

A table lamp with a rotatable lamp casing includes a base and an arm extended from the base. The arm has one end connected to the base and the other end connected to an assembling portion. A luminant portion is mounted on the assembling portion. The luminant portion has a seat mounted on the assembling portion and a lamp mounted on one side of the seat. A transparent casing is rotatably mounted on the assembling portion and covers the luminant portion. The casing has multiple light-guiding sections disposed therein. Each light-guiding section provides a specific illuminant mold.

11 Claims, 7 Drawing Sheets

TABLE LAMP WITH ROTATABLE LAMP CASING

BACKGROUND OF THE INVENTION

1. Field of the Invention

The present invention relates to a table lamp, and more particularly to a table lamp with a rotatable lamp casing.

2. Description of Related Art

A structure of a conventional table lamp includes a lamp holder composed of a post and a plurality of branches of hollow interior. A socket is disposed on a top of each of the branches. Each branch has a lamp mounted on the socket thereof. Each lamp has a transparent casing covered thereon for providing a protective effect.

However, each casing of the conventional table lamp is fixed on a corresponding branch. The casing is not rotatable for adjusting an illuminative direction. The lights emitted by the lamps of the conventional table lamp are widely and radially illuminated such that lights may not be effectively focused. Furthermore, an illuminated area, an illuminated form and a luminance of the conventional table lamp are not adjustable such that the conventional table lamp may be not suitable in different conditions.

The present invention has arisen to mitigate and/or obviate the disadvantages of the conventional table lamp.

SUMMARY OF THE INVENTION

The main objective of the present invention is to provide an improved table lamp with a rotatable lamp casing.

To achieve the objective, a table lamp with a rotatable lamp casing in accordance with the present invention comprises a base and an arm extended from the base. The arm has one end connected to the base and the other end connected to an assembling portion. A luminant portion is mounted on the assembling portion. The luminant portion has a seat mounted on the assembling portion and a lamp mounted on one side of the seat. A transparent casing is rotatably mounted on the assembling portion and covering the ruminant portion. The casing has multiple light-guiding sections disposed therein. Each light-guiding section provides a specific illuminant mold. The casing is rotated relative to the luminant portion for changing the light-guiding section corresponded to the lamp such that the illuminant mold is changed. A control system has a processing unit provided to be mounted on the assembling portion, a sensing unit electrically connected to the processing unit for sensing a position of the casing and adjusting an illuminant mold of the illuminant portion, and a controller electrically connected to the processing unit for adjusting the illuminant mold of the illuminant portion.

In accordance with another aspect of the present invention, the illuminant portion comprises a seat rotatably mounted on the assembling portion and multiple lamps mounted on the seat. The multiple lamps are respectively disposed on a corresponding side of the seat. The casing has multiple light-guiding sections disposed therein for respectively corresponding to the multiple lamps. The casing is rotated together with the seat such that the light-guiding section correspondingly covers the multiple lamps for changing the illuminant mold. Each light-guiding section has a button mounted thereon for correspondingly switching on/off the multiple lamps.

Further benefits and advantages of the present invention will become apparent after a careful reading of the detailed description with appropriate reference to the accompanying drawings.

DETAILED DESCRIPTION OF THE INVENTION

Figure 1:
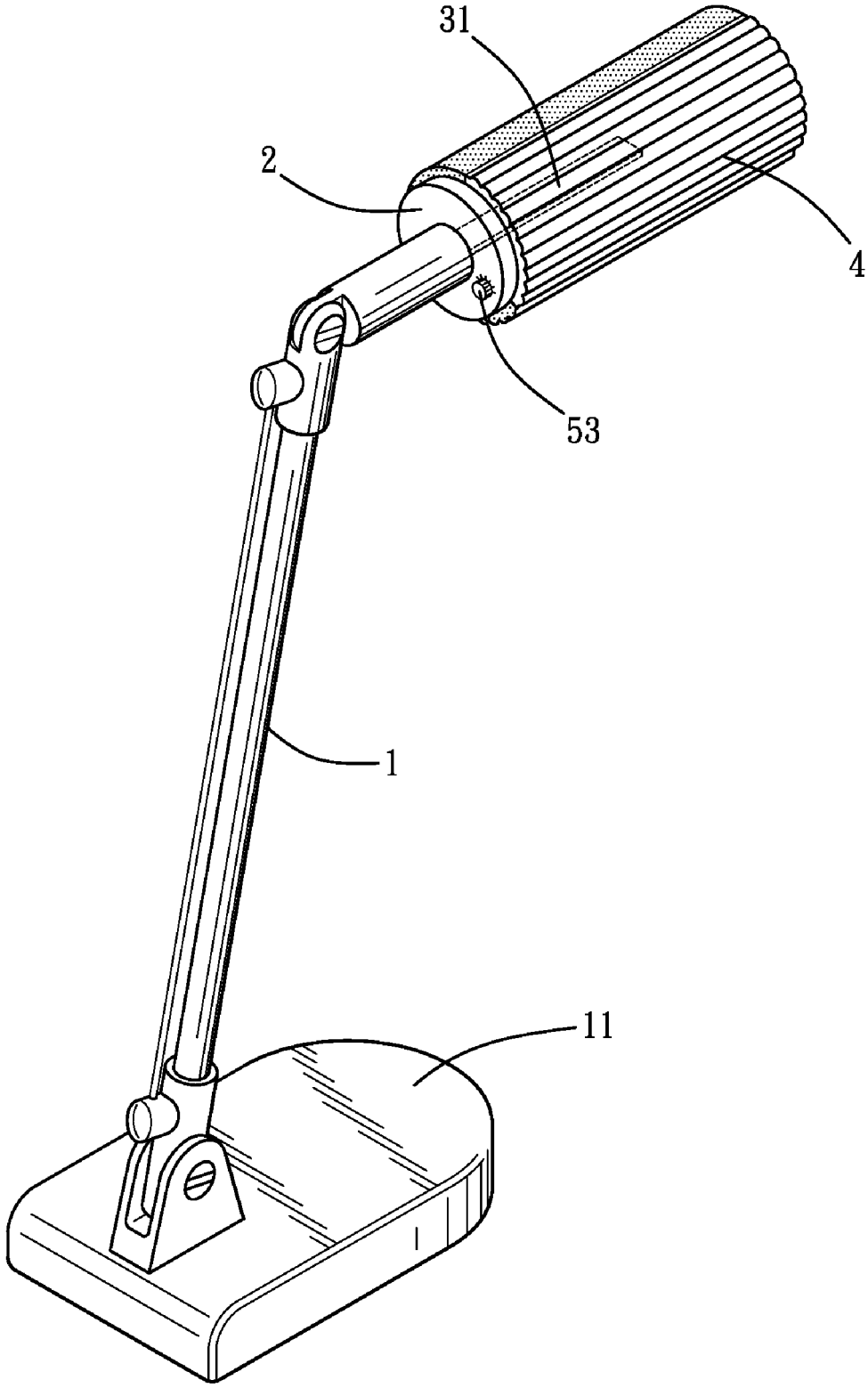
FIG. 1 is a perspective view of a table lamp with a rotatable lamp casing in accordance with the present invention.

Referring to the drawings and initially to FIGS. 1-4, a table lamp with a rotatable lamp casing in accordance with the present invention comprises a base 11 and an arm 1 extended from the base 11.

The base 11, in the preferred embodiment of the present invention, is in a disk shape. The base 11 is provided for an outer power source (not shown) or an inner power source (not shown) to the table lamp of the present invention. The arm 1 has one end connected to the base 11 and the other end connected to an assembling portion 2. The arm 1 is foldable relative to the base 11. A illuminant portion 3 is mounted on the assembling portion 2. The illuminant portion 3 has a seat 31 mounted on the assembling portion 2 and a lamp 32 mounted on a bottom of the seat 31. The lamp 32 is provided for downwardly emitting light beams.

A transparent casing 4 has a tubular structure. The casing 4 has one end rotatably mounted on the assembling portion 2 and the other end outwardly extending parallel to the seat 31. The luminant portion 3 is covered by the casing 4. The casing 4 is radially divided into multiple light-guiding sections 41 such that the multiple light-guiding sections 41 are disposed parallel to an axis of the tubular structure of the casing 4. In the preferred embodiment of the present invention, the casing 4 is radially divided into three light-guiding sections 41. Each light-guiding section 41 provides a specific illuminant mold. The multiple light guiding sections can be respectively formed in different patterns for providing different illuminant molds. In the preferred embodiment of the present invention, one of the three light-guiding sections 41 has multiple arc convexes 411 formed thereon for providing the illuminant mold having a specific curvature. Another of the three light-guiding sections 41 has multiple arc concaves 412 formed thereon for providing the illuminant mold having a specific curvature. The other of the three light-guiding sections 41 is filled with an optical material 413 for providing the illuminant mold for changing a color temperature, a chromatism, and a luminance of the lamp 32. The optical material 413 can be plastic particles or polyester particles.

Figure 2:
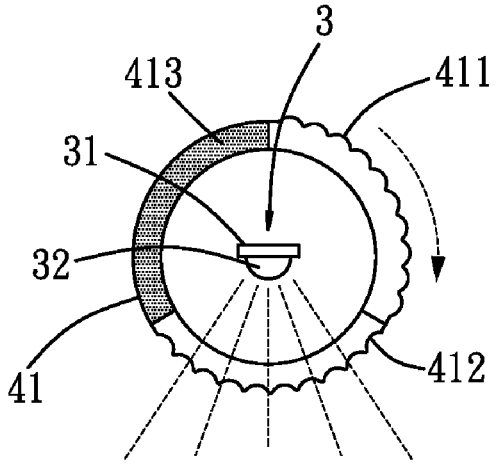
FIGS. 2-3 are operational views of the table lamp with the rotatable lamp casing in accordance with the present invention, showing a position of a casing relative to a luminant portion.
Figure 3:
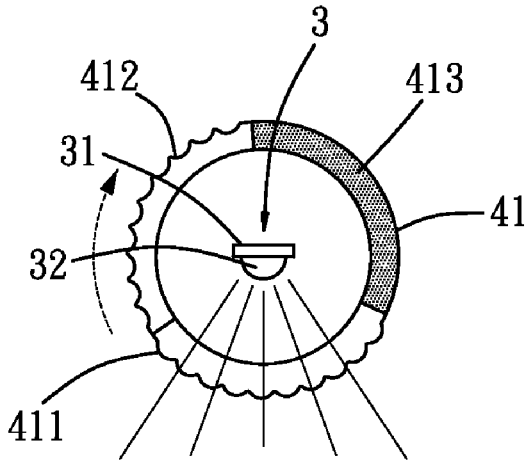

With reference to FIGS. 2-3, the lamp 32 downwardly emits light beams and the casing 4 is rotated relative to the ruminant portion 3. When the light-guiding section 41 of the casing 4 faces to the lamp 32, the light beams emitted by the lamp 32 are refractively changed due to the light-guiding section 41. The casing 4 is rotatable for changing the multiple light-guiding sections 41 such that the table lamp of the present invention adjustably provides different illuminated areas, different luminances, different color temperatures, and different chromatisms.

Figure 4:
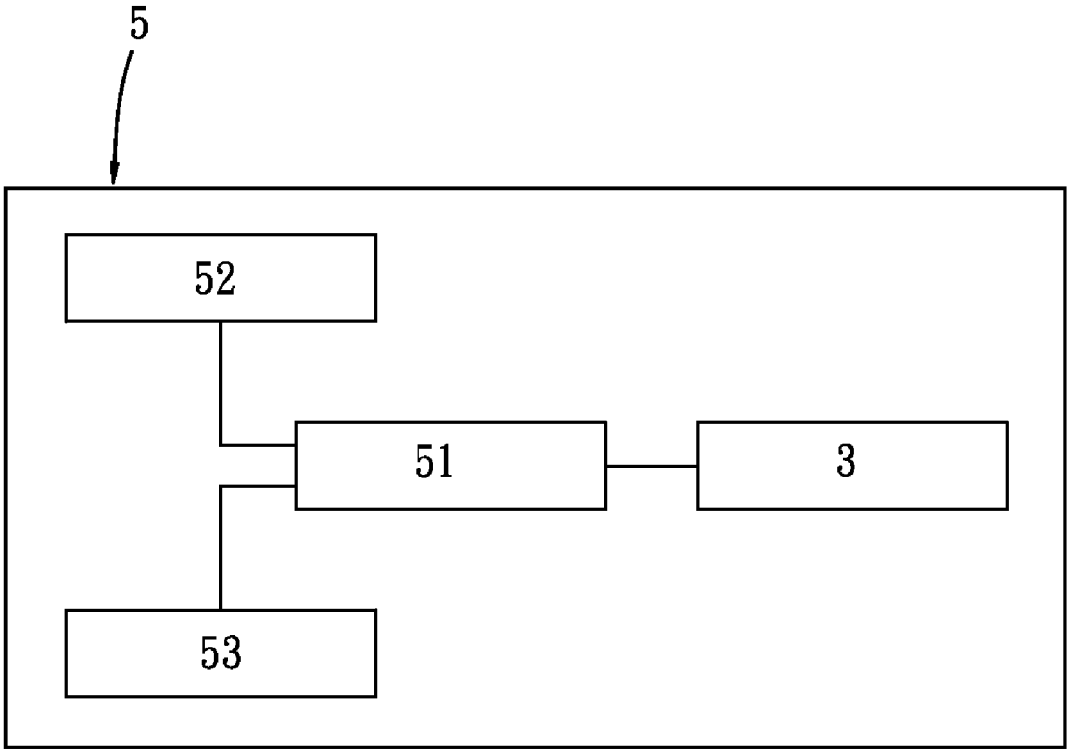
FIG. 4 is a block diagram of a control system of the table lamp with the rotatable lamp casing in accordance with the present invention.

With reference to FIG. 4, that shows a control system 5 for controlling an illuminant mold of the illuminant portion 3. The control system 5 includes a processing unit 51 mounted on the assembling portion 2, a sensing unit 52 electrically connected to the processing unit 51, and a controller 53 electrically connected to the processing unit 51. The sensing unit 52 is provided for automatically detecting a position of the casing 4 relative to the illuminant portion 3 such that the sensing unit 52 sends a signal to the processing unit 51 for adjusting the illuminant portion 3. The illuminant portion 3 controlled by the processing unit 51 provides an illuminant mold for changing a color temperature, a chromatism, and a luminance of the lamp 32. The controller 53 is provided for manually controlling the processing unit 51 to adjust the illuminant mold of the illuminant portion 3. In the preferred embodiment of the present invention, the controller 53 is a switch mounted on assembling portion 2. When the casing 4 is rotated relative to the luminant portion 3, the sensing unit 52 detects the position of the casing 4 being changed and the sensing unit 52 sends the signal to the processing unit 51 for adjusting the illuminant mold of the luminant portion 3. A user also can operate the controller 53 to directly adjust the illuminant mold of the illuminant portion 3.

Figure 5:
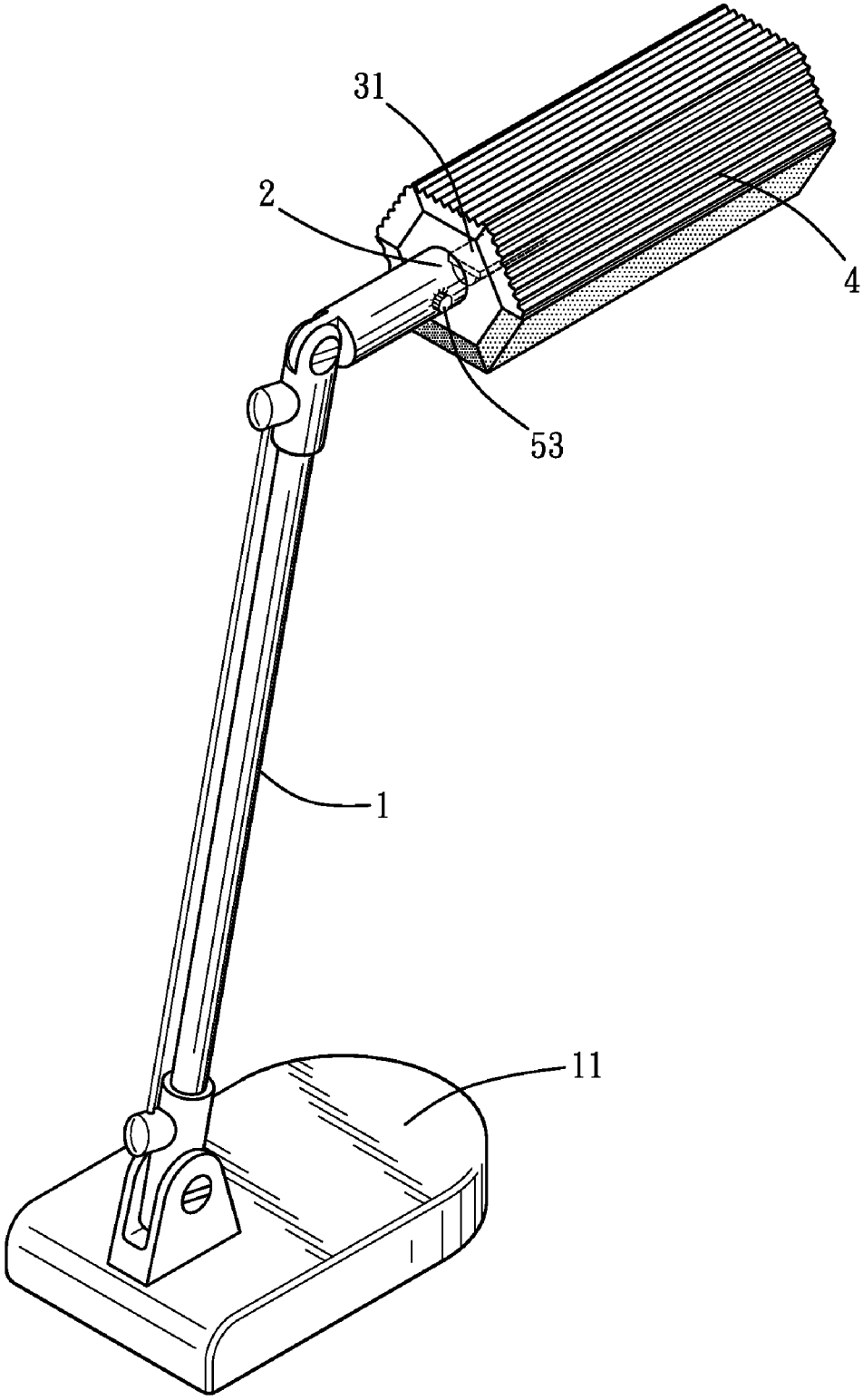
FIG. 5 is a perspective view of a second embodiment of the table lamp with the rotatable lamp casing in accordance with the present invention.
Figure 6:
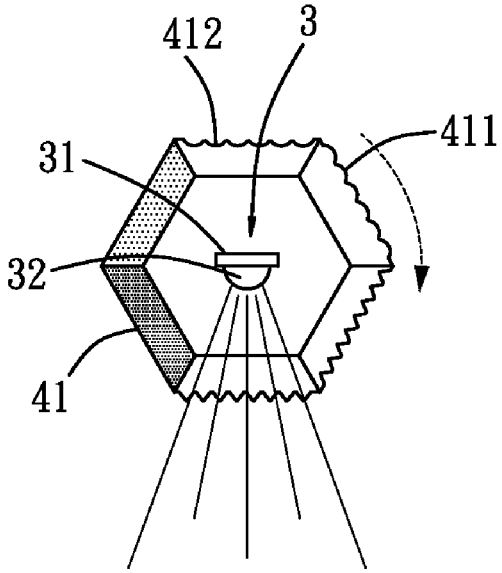
FIGS. 6-7 are operational views of the second embodiment of the table lamp with the rotatable lamp casing in accordance with the present invention, showing the position of the casing relative to the luminant portion.
Figure 7:
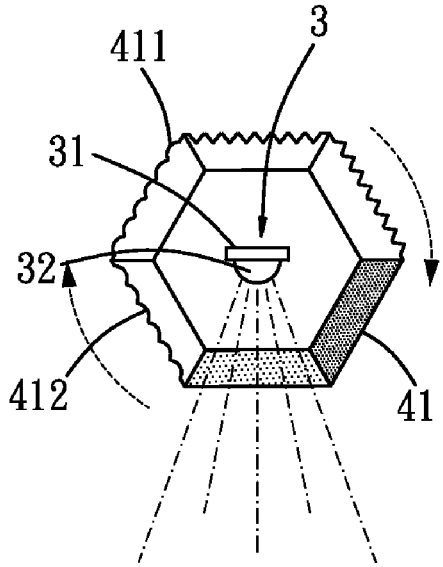

With reference to FIG. 5-7, that shows a second embodiment of the table lamp with a rotatable lamp casing in accordance with the present invention. The elements and effects of the second embodiment which are the same with the first embodiment are not described, only the differences are described. The casing 4 of the second embodiment of the present invention has a hexagonal tubular structure. The casing 4 is radially divided into six light-guiding sections 41. Each light-guiding section 41 provides a specific illuminant mold. Each light-guiding section 41 can be formed with multiple arc convexes 411, or be formed with multiple concaves, or be filled the optical material 413. Therefore, each light-guiding section 41 can provide a specific illuminant mold having a specific curvature, a specific color temperature, or a specific chromatism, or a specific luminance.

Figure 8:
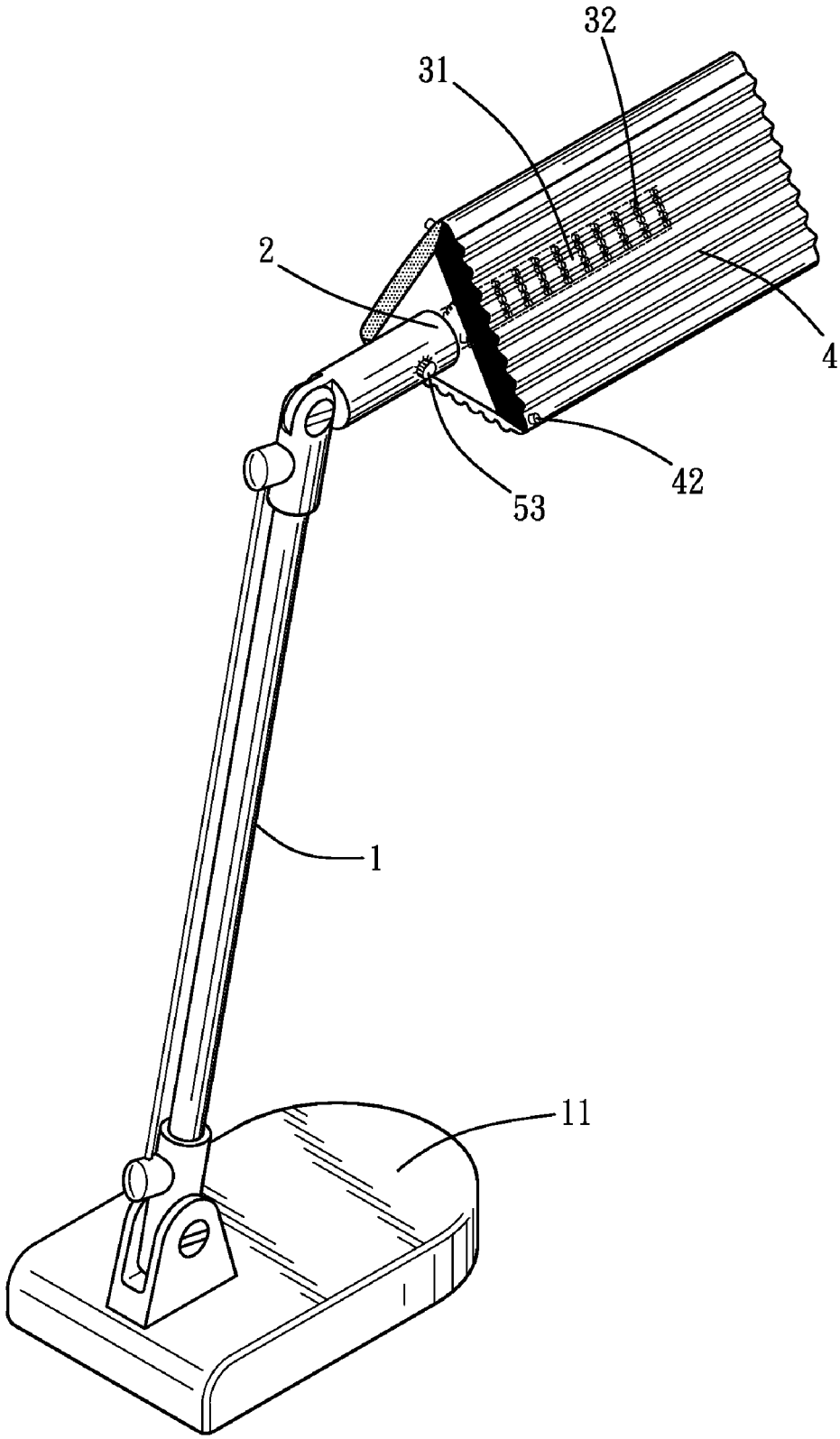
FIG. 8 is a perspective view of a third embodiment of the table lamp with the rotatable lamp casing in accordance with the present invention.
Figure 9:
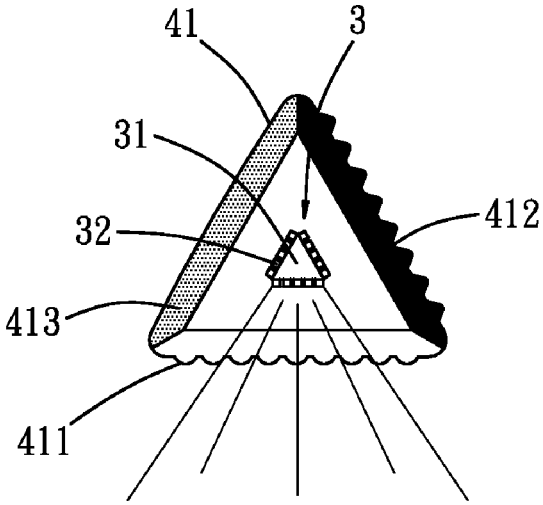
FIGS. 9-10 are operational views of the second embodiment of the table lamp with the rotatable lamp casing in accordance with the present invention, showing the position of the casing relative to the illuminant portion.
Figure 10:
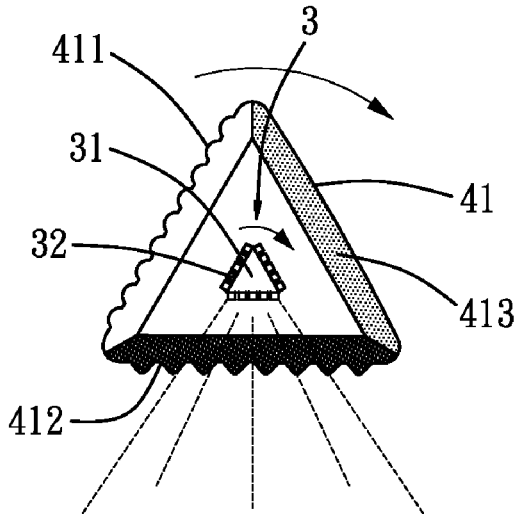

With reference to FIG. 8-10, that shows a third embodiment of the table lamp with a rotatable lamp casing in accordance with the present invention. The elements and effects of the third embodiment which are the same with the first embodiment are not described, only the differences are described. The seat 31 of the third embodiment of the table lamp with a rotatable lamp casing of the present invention has one end rotatably mounted on the assembling portion 2. The seat 31 is in a triangular prism shape. Each side of the triangular prism shape of the seat 31 has multiple lamps 32 mounted thereon. The casing 4 has a triangular prism tubular structure rotatably mounted on the assembling portion 2 and covering the seat 31. The casing 4 is radially divided into three light-guiding sections 41 for respectively corresponding to the multiple lamps 32 on the seat 31. The seat 31 is rotated together with the casing 4 such that each side of the triangular prism shape of the seat 31 is faced to a corresponding light-guiding section 41. Each light-guiding section 41 has a button 43 mounted thereon for switching on/off the corresponding lamps 32 mounted on the seat 31. When the button 43 mounted on one of the three light-guiding sections 41 is switched on, the other two buttons 43 are simultaneously switched off. Only one side of the lamps 32 on the seat 31 can be switched on at the same time.

Although the invention has been explained in relation to its preferred embodiment, it is to be understood that many other possible modifications and variations can be made without departing from the spirit and scope of the invention as hereinafter claimed.

What is claimed is:

1. A table lamp with a rotatable lamp casing comprising:

a base;

an arm extended from the base, the arm having one end connected to the base and the other end connected to an assembling portion;

a luminant portion mounted on the assembling portion, the luminant portion having a seat mounted on the assembling portion and an lamp mounted on one side of the seat;

a transparent casing rotatably mounted on the assembling portion and covering the luminant portion, the casing having multiple light-guiding sections disposed therein, each light-guiding section providing a specific illuminant mold; and a control system having a processing unit provided to be mounted on the assembling portion, a sensing unit electrically connected to the processing unit for sensing a position of the casing and adjusting an illuminant mold of the luminant portion, and a controller electrically connected to the processing unit for adjusting the illuminant mold of the luminant portion;

wherein the casing is rotated relative to the luminant portion for changing the light-guiding section corresponded to the lamp such that the illuminant mold is changed.

2. The table lamp with a rotatable lamp casing as claimed in claim 1, wherein the casing has a tubular structure, the multiple light-guiding sections respectively disposed in the casing parallel to an axis of the tubular structure of the casing.

3. The table lamp with a rotatable lamp casing as claimed in claim 1, wherein the light-guiding section has multiple arc convexes formed thereon for providing the illuminant mold having a specific curvature.

4. The table lamp with a rotatable lamp casing as claimed in claim 1, wherein the light-guiding section has multiple arc concaves formed thereon for providing the illuminant mold having a specific curvature.

5. The table lamp with a rotatable lamp casing as claimed in claim 1, wherein the light-guiding section is filled with an optical material for providing the illuminant mold for changing a color temperature, a chromatism, and a luminance of the lamp.

6. A table lamp with a rotatable lamp casing comprising:

a base;

an arm extended from the base, the arm having one end connected to the base and the other end connected to an assembling portion;

a luminant portion mounted on the assembling portion, the luminant portion having a seat rotatably mounted on the assembling portion and multiple lamps mounted on the seat, the multiple lamps respectively disposed on a corresponding side of the seat; and a transparent casing rotatably mounted on the assembling portion and covering the luminant portion, the casing having multiple light-guiding sections disposed therein for respectively corresponding to the multiple lamps, each light-guiding section providing a specific illuminant mold;

wherein the casing is rotated together with the seat such that the light-guiding section is correspondingly covered the multiple lamps for changing the illuminant mold; each light-guiding section has a button mounted thereon for correspondingly switching on or off the multiple lamps.

7. The table lamp with a rotatable lamp casing as claimed in claim 6, wherein the casing has a tubular structure, the multiple light-guiding sections respectively disposed in the casing parallel to an axis of the tubular structure of the casing.

8. The table lamp with a rotatable lamp casing as claimed in claim 6, wherein the light-guiding section has multiple arc convexes formed thereon for providing the illuminant mold having a specific curvature.

9. The table lamp with a rotatable lamp casing as claimed in claim 6, wherein the light-guiding section has multiple arc concaves formed thereon for providing the illuminant mold having a specific curvature.

10. The table lamp with a rotatable lamp casing as claimed in claim 6, wherein the light-guiding section is filled with an optical material for providing the illuminant mold for changing a specific color temperature, a specific chromatism, and a specific luminance of the lamp.

11. The table lamp with a rotatable lamp casing as claimed in claim 6 further comprising a control system having a processing unit mounted on the assembling portion, a sensing unit electrically connected to the processing unit for sensing a position of the casing and adjusting an illuminant mold of the luminant portion, and a controller electrically connected to the processing unit for adjusting the illuminant mold of the luminant portion.

* * * * *